US005231725A

United States Patent [19]

Hennessey et al.

[11] Patent Number: 5,231,725

[45] Date of Patent: Aug. 3, 1993

[54] NO-TOOL BRUSH CHANGING MEANS

[75] Inventors: Robert D. Hennessey, Golden Valley; Michael S. Wilmo, Crystal, both of Minn.

[73] Assignee: Tennant Company, Minneapolis, Minn.

[21] Appl. No.: 907,858

[22] Filed: Jul. 2, 1992

[51] Int. Cl.[5] ..... E01H 1/04

[52] U.S. Cl. ..... 15/83; 15/50.3; 15/179; 15/392

[58] Field of Search ..... 15/50.3, 52.1, 55, 82–86, 15/340.3, 340.4, 179, 392

[56] References Cited

U.S. PATENT DOCUMENTS 3,113,332 12/1963 Kasper ..... 15/82
3,284,830 11/1966 Kroll ..... 15/82
3,879,786 4/1975 Larkin ..... 15/82
3,892,003 7/1975 Peabody ..... 15/52.1
4,926,517 5/1990 Smith ..... 15/82

*Primary Examiner*—Edward L. Roberts
*Attorney, Agent, or Firm*—Kinzer, Plyer, Dorn, McEachran & Jambor

[57] ABSTRACT

A self-propelled industrial cleaning machine has a cylindrical horizontally mounted rotatable cleaning brush. There is a torsionally rigid connecting member extending generally parallel to the brush. A rigid arm is attached to each end of the connecting member, with each arm supporting an end of the brush. There is a hand operable latch for releasing one of the arms to permit removal or replacement of the brush, with the hand operable latch being arranged to retain the one arm and attachment to the connecting member, with release thereof permitting removal of the arm from the connecting member and brush.

6 Claims, 1 Drawing Sheet

NO-TOOL BRUSH CHANGING MEANS

BACKGROUND OF THE INVENTION

Sweepers and many scrubbers for cleaning building floors and paved outdoor areas have horizontally mounted cylindrical brushes that rotate against the surface to be cleaned. Such contact between brush and surface eventually wears out the brush, so from time to time it must be removed from the machine and replaced with a new or rebuilt brush. Brushes are also removed at times for inspection or to reverse them to assure even wear. These service operations occur often enough that a machine operator can save substantial amounts of time if such machines are designed so he can quickly and easily remove and replace brushes.

This need has long been recognized and various efforts have been made in this direction. One example is found in U.S. Pat. No. 3,892,003. It shows a small sweeper with a brush rotatably mounted between two brush arms attached to a torsionally stiff transverse member. One arm is flexible enough so that finger pressure on it will spring it away from the brush, thereby permitting the brush to be removed. This construction is suitable for a small sweeper where a brush arm that is light enough to be sprung by hand is strong enough for the intended service. For larger sweepers and scrubbers, however, such as riding-type industrial machines, much heavier duty brush arms are required, and of course these cannot be flexed by finger pressure.

On these heavier machines some form of a bolted connection is generally provided between a torsionally stiff transverse member and one brush arm. A brush can be removed after the one brush arm is unbolted from the transverse member and, of course, replacing the brush involves bolting the connection back together again. The best of these designs permit making a brush change in about five minutes once the job is begun. However, it requires the use of a wrench, which may not be available where the sweeper is. Also, in some union shops, a service operation on a machine may be done by the operator of the machine if no tools are used, but if tools are required the work must be done by a maintenance person. Sometimes there are delays in scheduling such work. So there is a long-felt need for a quick, no-tool method that a machine operator can easily use for changing brushes, at least in the larger sizes of industrial sweepers and scrubbers.

SUMMARY OF THE INVENTION

In the present invention one of two brush arms is removably coupled to a torsionally stiff transverse member in such a way that it can be removed and replaced without using any tools. After this brush arm is removed the brush can be easily removed and replaced. The transverse member has a flanged end which has reamed holes with dowel pins press fitted in them, the dowel pins extending somewhat beyond the surface of the flange. Matching slip fit dowel holes are provided in the removable brush arm, and for securing the two parts together a latch is provided that can be easily operated with the fingers of one hand. This latch and the dowel pins attach the brush arm to the flanged transverse member in such a manner that the requirements are met for a quick, easy, no-tool method of changing brushes.

There are other mechanisms that can provide a functional attachment and can be operated with no tools. For example, one alternative design is to use dowel pins as described above in conjunction with one special bolt having a large hand grip so that it can be tightened without a wrench to secure the brush arm to the transverse member. However, even a large hand grip does not have as much leverage as a wrench, so the bolt may not be securely tightened and may work loose. Also, the large hand grip may be hard to turn, and it takes up considerable space. A latch is currently the preferred means of attachment for use in the invention.

Dowel pins are used to provide torsional coupling between the brush arm and the transverse member. It will be recognized that other methods could accomplish this same purpose, such as, for example, a hexagonal boss on the end of the transverse member coupled with a mating hexagonal hole in the brush arm, or a splined end coupled with a splined hole. Either of these constructions and others known to persons skilled in the mechanical arts, would serve the purpose of the invention, but the dowel pins are preferred for manufacturing expediency. Two dowel pins are adequate, but more could be used if desired.

DETAILED DESCRIPTION OF THE INVENTION

Figure 1:
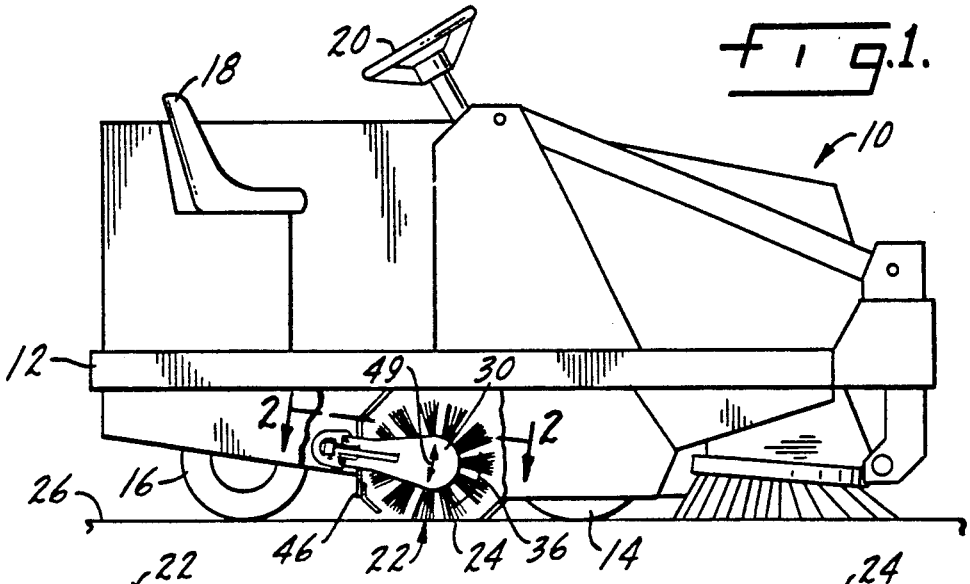
FIG. 1 shows a typical riding type industrial floor sweeper with some exterior covering broken away to show the invention installed in it.

Referring to FIG. 1, there is shown at 10 a typical riding type industrial sweeper on which the present invention has been advantageously installed. The sweeper 10 is entirely conventional except for the presence of the invention. The sweeper has a frame 12, and is supported by two front wheels 14 (only one shown) and one rear wheel 16, which also drives and steers the machine. There is a seat 18 and a steering wheel 20 for use by an operator. Many other features of the sweeper are not related to the present invention and so are not shown, or if shown will not be mentioned, as they are well known in the art.

Figure 2:
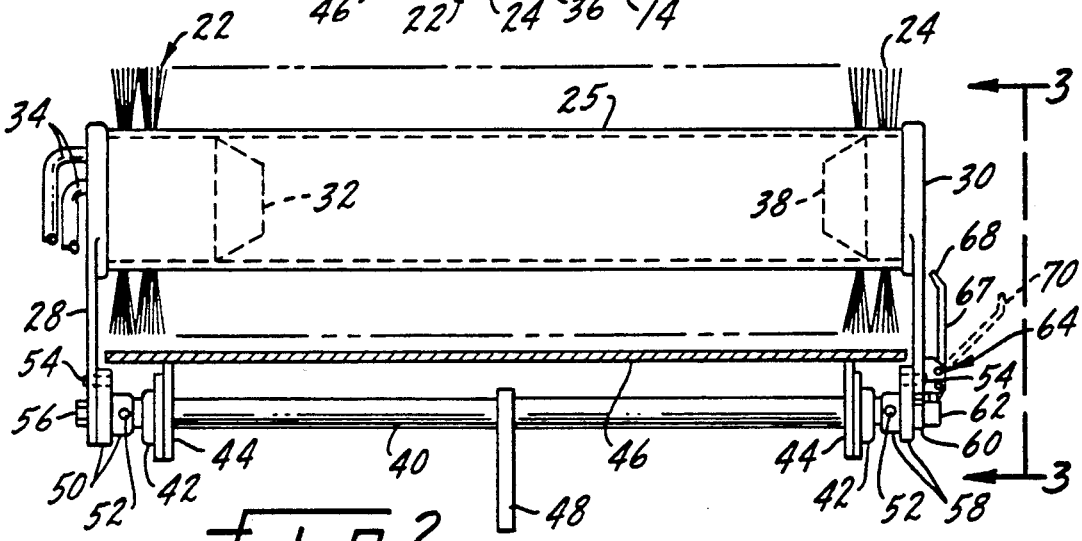
FIG. 2 is a view taken on line 2—2 of FIG. 1.
Figure 3:
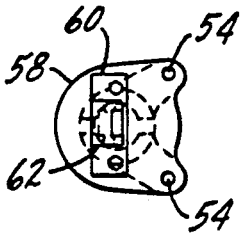
FIG. 3 is a view taken on line 3—3 of FIG. 2 showing the flanged end of the torsionally stiff transverse member. Other parts are omitted.
Figure 4:
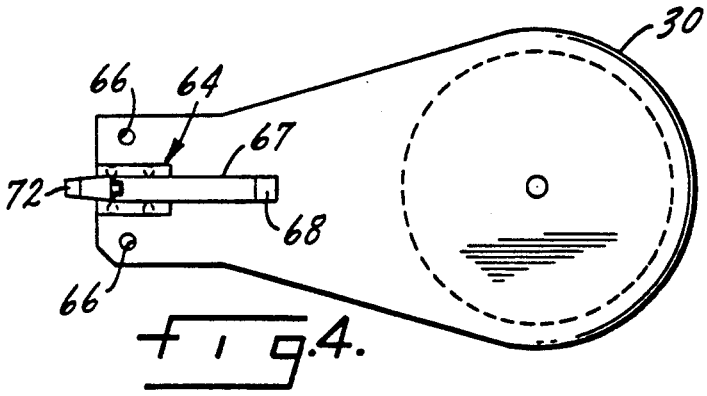
FIG. 4 is a view taken on line 3—3 of FIG. 2 showing the removable brush arm. Other parts are omitted.

Sweeper 10 is equipped with a main sweeping brush 22 which is entirely conventional. It contacts the floor or other surface 26 being swept. As best seen in FIG. 2, brush 22 is comprised of bristle tufts 24 affixed to a cylindrical core tube 25.

The brush 22 is rotatably supported on two brush arms 28 and 30. Brush drive arm 28 has a hydraulic motor (not shown) attached to it which is supplied by hydraulic lines 34. The hydraulic motor is inside a rotatable drive plug indicated at 32, and causes the drive plug to rotate. Drive plug 32 has splines on its surface which fit with splines on the inside of core tube 25, so brush 22 is caused to rotate as shown by arrow 36 in FIG. 1. Brush idler arm 30 includes an idler plug indicated at 38 which is rotatably attached to arm 30 with ball bearings. As shown in FIG. 2, drive arm 28 is on the left and idler arm 30 is on the right, but this can be reversed if desired.

Brush arms 28 and 30 must be held in fixed alignment with each other to properly support brush 22, so they are attached to the ends of a torsionally stiff cross shaft 40. This shaft is mounted in two flange bearings 42 which are bolted to two brackets 44. These are welded or otherwise attached to brush wrap 46, which is part of the housing for brush 22 and is a structural part of the machine frame 12. Cross shaft 40 may have a lift lever 48 welded or otherwise attached to it if desired. Lever 48 may be connected to controls for lifting and lowering brush 22, as indicated by double ended arrow 49 in FIG. 1. This up and down motion of the brush will be on an arc centered in cross shaft 40, and will be accomodated by cross shaft 40 rotating in bearings 42.

As shown in FIG. 2, at each end of cross shaft 40 there is a flanged member having a hub which fits the shaft and is pinned to it. At the left end of cross shaft 40 is flanged member 50, attached to the shaft by pin 52. Flanged member 50 has one threaded hole and two reamed holes. Two dowel pins 54 (only one shown) are pressed into the reamed holes and project beyond the surface of the flange. Brush drive arm 28 has two slip fit holes that align with the dowel pins and one clearance bolt hole aligned with the threaded hole in the flange. Bolt 56 passes through arm 28 and screws into flanged member 50, so the two dowel pins 54 and one bolt 56 cooperate with flanged member 50 and pin 52 to securely attach brush drive arm 28 to cross shaft 40. What has been described so far is conventional. The description has been given to provide an understanding of the structure in which the present invention is used. A description of the preferred embodiment of the invention follows.

At the right end of cross shaft 40 is flanged member 58. It is similar to flanged member 50, in that it is bored to fit shaft 40, is pinned to it with a pin 52, and has two reamed holes with dowel pins 54 pressed into them. However, flanged member 58 is not threaded for a bolt such as 56. Instead, it has attached to it a spacer 60 and a strike plate or box 62 which cooperates with latch assembly 64.

Brush idler arm 30 has two slip fit holes 66 in it which match up with dowel pins 54 in flanged member 58. Arm 30 also has latch assembly 64 attached to it. Latch assembly 64 may be a commercially available item, such as, for example, part no. A7-10-351-20 made by Southco Fasteners of Concordville, Pa. It has a handle 67 which moves between an engaged position 68 and a released position 70. The tongue 72 of the latch assembly enters strike box 62 when the latch is engaged and securely holds brush arm 30 against flanged member 58. However, by pulling latch handle 67 to position 70 a person can release the engagement of tongue 72 in strike box 62, following which it is an easy task to slip arm 30 off of dowel pins 54 and pull idler plug 38 out of brush tube 25. Brush 22 can then be pulled off of drive plug 32 and removed from the machine. Replacing brush 22 is just as simple, being the reverse of the above described procedure.

While the invention has been described in terms of its application to an industrial sweeper, it should be realized that the same brush-changing problem is found in many industrial scrubbers, and the method used for mounting brushes in them makes the present invention as applicable to them as to industrial sweepers.

Whereas the preferred form and several variations of the invention have been shown, described, and suggested, it should be understood that suitable additional modifications, changes, substitutions and alterations may be made without departing from the invention's fundamental theme. It is therefore wished that the invention be unrestricted except as by the appended claims.

The embodiments of the invention in which an exclusive property is claimed are defined as follows:

1. In a self-propelled industrial cleaning machine, a cylindrical horizontally mounted rotatable cleaning brush, a torsionally rigid connecting member extending generally parallel to and radially spaced from said brush, a rigid arm attached to each end of said connecting member, with each arm supporting an end of said brush, and a hand-operated latch having a movable keeper for releasing one of said arms to permit removal or replacement of said brush, said hand operable latch being arranged to retain said one of said arms in attachment to said connecting member, with release thereof permitting removal of said one arm from said connecting member and brush.

2. The cleaning machine of claim 1 further characterized in that said hand operable latch includes a strike member mounted on an end of said connecting member, said movable keeper being mounted on said one arm.

3. The cleaning machine of claim 2 further characterized in that said keeper is pivotally mounted on said one arm.

4. The cleaning machine of claim 3 further characterized in that the attachment of said one rigid arm to said connecting member includes a sliding connection therebetween.

5. The cleaning machine of claim 4 further characterized in that the sliding connection includes a plurality of pins extending outwardly from said rigid connecting member, and a plurality of openings in said one rigid arm.

6. The cleaning machine of claim 1 further characterized in that said hand-operated latch is releasable without the use of tools.

* * * * *